US010577715B2

(12) United States Patent
Hoffman, Jr. et al.

(10) Patent No.: US 10,577,715 B2
(45) **Date of Patent: *Mar. 3, 2020**

(54) FOUNDRY MIXTURE AND RELATED METHODS FOR CASTING AND CLEANING CAST METAL PARTS

(71) Applicant: York Innovators Group, LLC, York, PA (US)

(72) Inventors: John E. Hoffman, Jr., Hummelstown, PA (US); Richard A. Hoffman, Sr., Harrisburg, PA (US)

(73) Assignee: York Innovators Group, LLC, York, PA (US)

( * ) Notice: Subject to any disclaimer, the term of this patent is extended or adjusted under 35 U.S.C. 154(b) by 128 days.

This patent is subject to a terminal disclaimer.

(21) Appl. No.: 15/962,293

(22) Filed: Apr. 25, 2018

(65) Prior Publication Data

US 2018/0245234 A1 Aug. 30, 2018

Related U.S. Application Data

(63) Continuation of application No. 14/719,542, filed on May 22, 2015, now Pat. No. 9,963,799, which is a continuation-in-part of application No. 14/511,432, filed on Oct. 10, 2014, now Pat. No. 9,038,708.

(60) Provisional application No. 62/013,832, filed on Jun. 18, 2014, provisional application No. 62/043,925, filed on Aug. 29, 2014.

(51) Int. Cl.

| | |
|---|---|
| ***B22C 1/02*** | (2006.01) |
| ***B22C 1/22*** | (2006.01) |
| ***B22D 29/00*** | (2006.01) |
| ***C25F 1/00*** | (2006.01) |
| ***B22D 29/04*** | (2006.01) |
| ***C25F 7/00*** | (2006.01) |

(52) U.S. Cl.

CPC ..... *C25F 1/00* (2013.01); *B22C 1/02* (2013.01); *B22C 1/22* (2013.01); *B22D 29/001* (2013.01); *B22D 29/04* (2013.01); *C25F 7/00* (2013.01)

(58) Field of Classification Search

CPC .. B22C 1/02; B22C 1/16; B22C 1/181; B22C 1/22; B22D 29/00; B22D 29/001; B22D 29/04; C25F 1/00

USPC ..... 164/520, 525, 526, 527, 528; 106/38.2, 106/38.22, 38.9; 523/139; 205/674, 705

See application file for complete search history.

(56) References Cited

U.S. PATENT DOCUMENTS 9,038,708 B1 * 5/2015 Hoffman, Jr. et al. ... B22C 1/02 164/526
9,963,799 B2 * 5/2018 Hoffman, Jr. et al. ... B22C 1/02

* cited by examiner

*Primary Examiner* — Kevin P Kerns
(74) *Attorney, Agent, or Firm* — Hooker & Habib, P.C.

(57) ABSTRACT

A foundry mixture for making molds used for molding cast metal parts includes foundry sand, a non-aqueous binder, and a cleaning agent that includes calcium oxide. Residual foundry mixture remaining on the cast part after removal from the mold is removed by electrolytic cleaning of the cast part.

20 Claims, 1 Drawing Sheet

FOUNDRY MIXTURE AND RELATED METHODS FOR CASTING AND CLEANING CAST METAL PARTS

RELATED APPLICATIONS

This application is a continuation of and claims priority from our U.S. patent application Ser. No. 14/719,542 "Foundry Mixture And Related Methods For Casting And Cleaning Cast Metal Parts" filed May 22, 2015 and which issued as U.S. Pat. No. 9,963,799 on May 8, 2018, which in turn is a continuation-in-part of and claims priority from U.S. patent application Ser. No. 14/511,432 "Foundry Mixture And Related Methods For Casting And Cleaning Cast Metal Parts" filed Oct. 10, 2014 and which issued as U.S. Pat. No. 9,038,708 on May 26, 2015, and which in turn claims priority from our two provisional patent applications U.S. Patent Application No. 62/013,832 filed Jun. 18, 2014 and U.S. Patent Application 62/043,925 filed Aug. 29, 2014, all of which are each incorporated by reference as if fully set forth herein.

FIELD OF THE DISCLOSURE

The disclosure relates to a material composition useful as a foundry mixture for forming a mold for foundry casting and related methods for improved removal of remaining or residual foundry mixture from metal parts made by foundry casting.

BACKGROUND OF THE DISCLOSURE

Now expired U.S. patent application Ser. No. 14/719,589 "Foundry Mixture And Related Methods For Casting And Cleaning Cast Metal Parts" filed May 22, 2015 is incorporated by reference herein as if fully set forth herein.

The disclosure relates to:

(a) a foundry mixture that consists of a dry, granular refractory material (typically sand), a binder, optional additives, and a cleaning agent, and (b) a method for molding and/or electrolytic cleaning of a metal part molded in a mold formed from the foundry mixture.

A common manufacturing method for the production of metal parts is foundry casting. Metal castings are cast in molds or receptacles formed from a conventional foundry mixture consisting of granulated foundry sand and a cured binder. The granulated sand takes the desired shape of the mold and the cured binder enables the granulated sand to retain the shape of the mold. The mold includes a shell defining a mold cavity. The mold may optionally include one or more cores placed in the mold cavity to define hollow elements or passages in the cast metal part, with the shell and cores defining the shape of the casting. Liquid metal is poured into the mold cavity and solidifies upon cooling to form the casting. The solid casting is then removed from the mold.

Some binders may include a binder material that is treated to hold or bond the refractory material within a rigid binder matrix. Other binders may include a compatible suspension agent along with the binder material that reacts with or otherwise cooperates with the binder material to hold or bond the foundry sand within a rigid binder matrix.

One type of binder includes a resin as the binder material and may utilize a suitable catalyst as the suspension agent. The resin cures to form a cured resin matrix. Resins commonly used as binder materials include (but are not limited to) urea formaldehyde (UF), phenol formaldehyde (PF) resins, and natural or synthetic gums.

Binders that form a cured resin matrix are referred to as "resin binders" herein. Resin binders may use a resin alone (that is, the resin binder does not include a suspension agent) or may include a resin and a catalyst as suspension agent.

The resin may be a thermosetting resin or heat-cured resin that cures or cross-links when heated, or the resin may require the presence of a catalyst to induce curing or cross-linking of the resin. When the foundry mixture is formed, the resin is treated to cure the resin. Specific resins use different types of treatment to form the matrix. "Hot-box", "cold-box", and "no-bake" are examples of different treatment types.

Hot-box treatment utilizes pre-heating the foundry mixture with a thermosetting resin binder. The foundry mixture is typically heated to temperatures between about 35 degrees Centigrade and about 300 degrees Centigrade to cure the resin. Resins used in hot-box treatment may include furan resins and furfuryl alcohols. Typically the resins are cured in the presence of a latent acid curing catalyst.

Cold-box treatment utilizes passing a vapor or gas catalyst through the foundry mixture to induce curing of the resin. The resin used is typically a phenolic urethane. A gaseous tertiary amine curing catalyst is passed through the shaped sand and resin mixture to cure the mixture. The catalyst may be TEA (tetraethylamine) and DMEA (dimethylethylamine). The sand and resin mixture may be shaped in a pattern and allowed to cure and become self-supporting to form the mold.

No-bake treatment utilizes a catalyst added directly to the resin that cures the resin at ambient temperatures without the need for baking. The resin used is typically a phenolic urethane. The suspension agent includes a solvent that reacts with a liquid curing catalyst mixed with the sand and resin before shaping. The foundry mixture typically cures 30 minutes to a few hours after mixing in the solvent.

Binders that do not utilize a resin are referred to as "non-resin binders" herein.

Some types of non-resin binders utilize water or some other liquid (such as vegetable oil, marine oil, or other liquids known in the art) as a suspension agent that binds the binder material together. Non-resin binders that utilize water or other liquid as a suspension agent are referred to as "liquid cured binders" herein. Liquid cured binders that utilize water as a suspension agent are referred to as "aqueous binders" herein, while binders that do not utilize water as a suspension agent are referred to as "non-aqueous binders" herein. Resin binders that are heat cured or catalyst cured, for example, are non-aqueous binders.

Some types of aqueous binders include clays (such as bentonite or kaolinite) or other solid mineral agent as the binder material. The sand, mineral agent, and water are mixed together. There is sufficient water and time after mixing to hydrate the binder material and form a mortar. The mortar dries and becomes rigid, thereby holding the sand within a mortar matrix.

Some aqueous binders utilize calcium oxide, CaO, as a precursor binder material. The calcium oxide reacts with the water suspension agent to form a calcium hydroxide mortar. There is effectively no calcium oxide in the foundry mixture after the calcium oxide has hydrated and the binder has cured.

Some types of binders include a non-resin binder material that is cured by heating. Such binders are referred to as heat-cured non-resin binders herein.

One type of heat-cured non-resin binder includes inorganic clay components such as aluminum silicate, bentonite, or montmorillonite as a binder material. In embodiments the clay is heated to form a clay binder matrix that holds the sand within the clay matrix.

Yet other types of non-resin binders include sodium silicate as a binder material.

Binders in a foundry mix in which the binder material has been treated to form the binder matrix are referred to as "cured binders" herein. Cured binders include cured resin binders in which the resin has been cured by heating or by catalyst reaction to form a resin binder matrix, cured liquid cured binders in which the binder material has been mixed with a liquid and reacts to form a cured binder matrix, and heat-cured binders in which the binder material has been heated to form a cured binder matrix.

The foundry mixture may also optionally include additional material or materials to improve the finish of casting surfaces, the dry strength of the mold, refractoriness, and "cushioning" (the creation of voids in the mold that enable the mold to expand when metal is poured into the mold), or to provide other desirable characteristics in the finished mold.

Typically, up to 5% of reducing agents, such as coal powder, pitch, creosote, and fuel oil, may be added to the foundry mixture to prevent wetting (liquid metal sticking to sand particles, thereby leaving sand particles on the casting surface), improve surface finish, decrease metal penetration, and burn-on defects. These additives achieve this by creating gases at the surface of the mold cavity, which prevent the liquid metal from adhering to the sand.

Typically, up to 3% of "cushioning material", such as wood flour, saw dust, powdered husks, peat, and straw, can be added to the foundry mixture to reduce scabbing, hot tear, and hot crack casting defects when casting high temperature metals. These materials burn-off when the metal is poured, thereby creating voids in the mold that allow the mold to expand.

Typically, up to 2% of cereal binders, such as dextrin, starch, sulphite lye, and molasses, can be used in the foundry mixture to increase dry strength (the strength of the mold after curing) and improve surface finish. Cereal binders also improve collapsibility and reduce shakeout time because they burn-off when the metal is poured.

Typically, up to 2% of iron oxide powder can be used in the foundry mixture to prevent mold cracking and metal penetration, essentially improving refractoriness. Silica flour (fine silica) and zircon flour may also improve refractoriness.

Material or materials added to the foundry mixture to improve the finish of casting surfaces, the dry strength of the mold, refractoriness, and/or cushioning are referred to as "additives" herein.

After casting, sand and binder still adhering to casting surfaces are typically removed by mechanical agitation of the casting, shot blasting, or other mechanical cleaning methods. Alternatively, the casting may be dipped into a molten bath.

Used sand cleaned from the casting has economic value. Used foundry sand is, for example, used as a fine aggregate in making concrete.

Often after mechanical cleaning of the casting or removal of the casting from the molten bath, some sand and binder remains adhering to casting surfaces. Removal of this remaining foundry mixture is often difficult and time consuming.

Hathaway US Patent Application Publications 20050087323 and 20050087321 each disclose a foundry mixture that includes sand, a resin binder, and a disintegration additive that reportedly assists in removing the foundry mixture from casting surfaces. The casting is electrolytically cleaned after being removed from the mold. The disintegration additive assists during the electrolytic cleaning in removing the remaining foundry mixture adhering to casting surfaces.

The disintegration additive is a salt that is preferably inorganic and soluble in water. Preferred embodiments of the mixture include disintegration additives having relatively high melting points (above 300 degrees C., which is much lower than the melting points of common cast metals such as iron, steel, titanium, or aluminum).

Specific examples of disintegration additives are given in paragraph 22 of the '323 publication. Preferred anions for the salt of the disintegration additives include carbonates, nitrates, sulfates, phosphates, hydroxides, and halogens. Certain preferred salts include cations of sodium, potassium, calcium, ammonium, or magnesium, and include salts, such as for example: sodium carbonate, sodium bicarbonate, sodium chloride, sodium hydroxide, sodium iodide, sodium nitrate, sodium phosphate, disodium phosphate, sodium sulfate, potassium carbonate, potassium chloride, potassium hydroxide, potassium iodide, potassium nitrate, potassium phosphate, potassium sulfate, calcium carbonate, calcium chloride, calcium hydroxide, calcium iodide, calcium nitrate, calcium sulfate, ammonium sulfate, ammonium carbonate, magnesium carbonate, magnesium chloride, magnesium hydroxide, magnesium iodide, magnesium nitrate, magnesium phosphate, magnesium sulfate, and equivalents and mixtures thereof. The disintegration additive may be selected from the group consisting of sodium chloride, potassium chloride, sodium carbonate, sodium bicarbonate, sodium phosphate, and mixtures thereof. The disintegration additive may comprise sodium chloride. The disintegration additive may comprise sodium bicarbonate, disodium phosphate, and mixtures thereof. The disintegration additive may comprises sodium carbonate, disodium phosphate, and mixtures thereof.

Hathaway discloses in embodiments that the disintegration additive reportedly enhances the electron ion conduction of the casting when contacted with a polar electrolyte such as water. Water soluble salts would be suitable for such disintegration agents.

Hathaway discloses in other embodiments that the disintegration additive volatilizes during casting of the metal part, leaving behind a porous and slightly unstable mold structure. Hence, the melting point of such disintegration agents must be below the melting point of the metal being cast.

It has been found, however, that volatizing the disintegration additive during casting may adversely impact mold strength, and may adversely impact the finish of the casting surfaces. Furthermore, some disintegration additives include sodium that impairs the economic value of used, recovered sand. The sodium contaminates the used sand, making the sand unsuitable as a fine aggregate in concrete.

BRIEF SUMMARY OF THE DISCLOSURE

Disclosed is a foundry mixture for foundry casting for use in making at least a portion of a mold for a cast part that includes a granular refractory material, a binder, optional additives, and a cleaning agent. In embodiments the binder may be a resin binder, a non-resin binder, a liquid cured binder, or a heat cured binder material.

If the foundry mixture has not yet been cured to enable the refractory material to retain a desired shape, the binder may include only a binder material. If the foundry mixture has been cured, the binder material may include a suspension agent that has reacted with the binder material.

By "optional additives" it is meant that the foundry mixture may contain one or more additives or may contain no additives.

In an embodiment, the foundry mixture includes a granular refractory material, a non-aqueous binder, optional additives, and a cleaning agent.

The granular refractory material may be foundry sand.

Also disclosed is a foundry mold formed for the casting of a part that includes granular refractory material, a cured binder, optional additives, and a cleaning agent. In embodiments the cured binder may be a cured resin binder, a cured non-resin binder, a cured liquid cured binder, or a cured heat cured binder. The cured binder may or may not include a suspension agent.

Also disclosed is a method of forming a casting that includes the steps of pouring molten metal into a mold, the mold being formed of a foundry mixture that includes a granular refractory material, a cured binder, optional additives, and a cleaning agent. The cured binder may be a cured resin binder, a cured non-resin binder, a cured liquid cured binder, or a cured heat cured binder. The cured binder may or may not include a suspension agent. The molten metal is cooled to form a solid casting in the mold, and the solid casting is removed from the mold.

Also disclosed is a method of forming a casting that includes the steps of pouring molten metal into a mold, the mold being formed of a foundry mixture that includes a granular refractory material, a cured binder, optional additives, and a cleaning agent. The cured binder may be a cured resin binder, a cured non-resin binder, a cured liquid cured binder, or a cured heat cured binder. The cured binder may or may not include a suspension agent. The molten metal is cooled to form a solid casting in the mold, and the solid casting is removed from the mold.

Also disclosed is a method for removing residual foundry mixture from a metal casting wherein the method includes the steps of: electrolytically cleaning a cast metal part, the foundry mixture including a granular refractory material, a cured binder, optional additives, and a cleaning agent. The cured binder may be a cured resin binder, a cured non-resin binder, a cured liquid cured binder, or a cured heat cured binder. The cured binder may or may not include a suspension agent.

Also disclosed is a method for removing a residual foundry mixture from a metal casting wherein the method includes the steps of: electrolytically cleaning a cast metal part, the foundry mixture including a granular refractory material, a cured binder, optional additives, and a cleaning agent. The cured binder may be a cured resin binder, a cured non-resin binder, a cured liquid cured binder, or a cured heat cured binder. The cured binder may or may not include a suspension agent.

An embodiment of the step of electrolytically cleaning the cast metal part includes the step of attaching the metal casting having residual foundry mixture to a power source having a first and a second electrode of opposite polarities, wherein the first electrode is attached to the metal casting. The metal casting is immersed in or otherwise wetted by an electrolyte that is in contact with the second electrode. Current is generated through the electrolyte, from the first electrode to the second electrode.

In an embodiment the electrolyte is an alkaline electrolyte. The electrolyte may be formed by mixing potassium carbonate with water. The electrolyte may have a pH of about 12 or greater.

The cleaning agent is calcium oxide (CaO). The calcium oxide is added and mixed with the granular refractory material, binder, and optional additives to form a foundry mixture. The calcium oxide may be added to the foundry mixture in a finely ground or powdered form. In embodiments the ground or powdered calcium oxide may have a fineness of between about 100 mesh to about 500 mesh, which corresponds to a particle size of between about 0.0059 inches and about 0.001 inches.

The calcium oxide may, in possible embodiments of the foundry mixture, be between about one-half percent (½%) and about five percent (5%) by weight or by volume of the weight or volume of the refractory material n the foundry mixture. The calcium oxide, may, in possible embodiments of the foundry mixture, be between about one-half percent (½%) and about five percent (5%) by weight or by volume of the sum of the weight or volume of the refractory material and the binder in the foundry mixture. Other embodiments may use more or less calcium oxide.

Calcium oxide as a cleaning agent in a foundry mixture that contains a cured binder forms a solid mold capable of accepting molten metal for casting. The calcium oxide does not form part of the cured binder, that is, the calcium oxide has not reacted with the binder material to cure the binder. Like the refractory material, the calcium oxide will be held and distributed within the binder matrix like the refractory material.

Calcium oxide is not a salt and is essentially insoluble in water. Calcium oxide has a melting point of 2,572 degrees Centigrade, substantially higher than the melting points of aluminum, brass, bronze, iron, copper, gold, lead, magnesium, nickel, silver, steel, tungsten, zinc, and other commonly cast metals. The calcium oxide does not vaporize during casting and so maintains good surface quality of the casting and does not produce an unstable mold structure.

Calcium oxide as used in the disclosed foundry mixture as a cleaning agent is not a disintegrating agent as defined by Hayword: the calcium oxide does not vaporize during casting of the metal part and so casting does not form a porous and unstable mold structure, and the calcium oxide does not enhance the electron ion conduction of the casting when contacted with a polar electrolyte such as water.

The cleaning agent results in more efficient electrolytic cleaning of a residual foundry mixture from a metal casting. The exact mechanism by which the cleaning agent is not known, and any speculation as to the cleaning mechanism is not intended to be limiting in any way.

Calcium oxide in particular is inexpensive and is widely available. Calcium oxide is compatible with the manufacture of concrete and so the presence of calcium oxide in the binder does not adversely impact the economic value of the used foundry sand.

Further areas of applicability of the disclosure will become apparent from the detailed description provided hereinafter. It should be understood that the detailed description and specific examples, while indicating specific disclosed embodiments, are intended for purposes of illustration only and are not intended to limit the scope of the disclosure.

Other objects and features of the disclosure will become apparent as the description proceeds, especially when taken in conjunction with the accompanying drawing sheets illustrating the one or more non-limiting embodiments.

DETAILED DISCLOSURE

Figure 1:
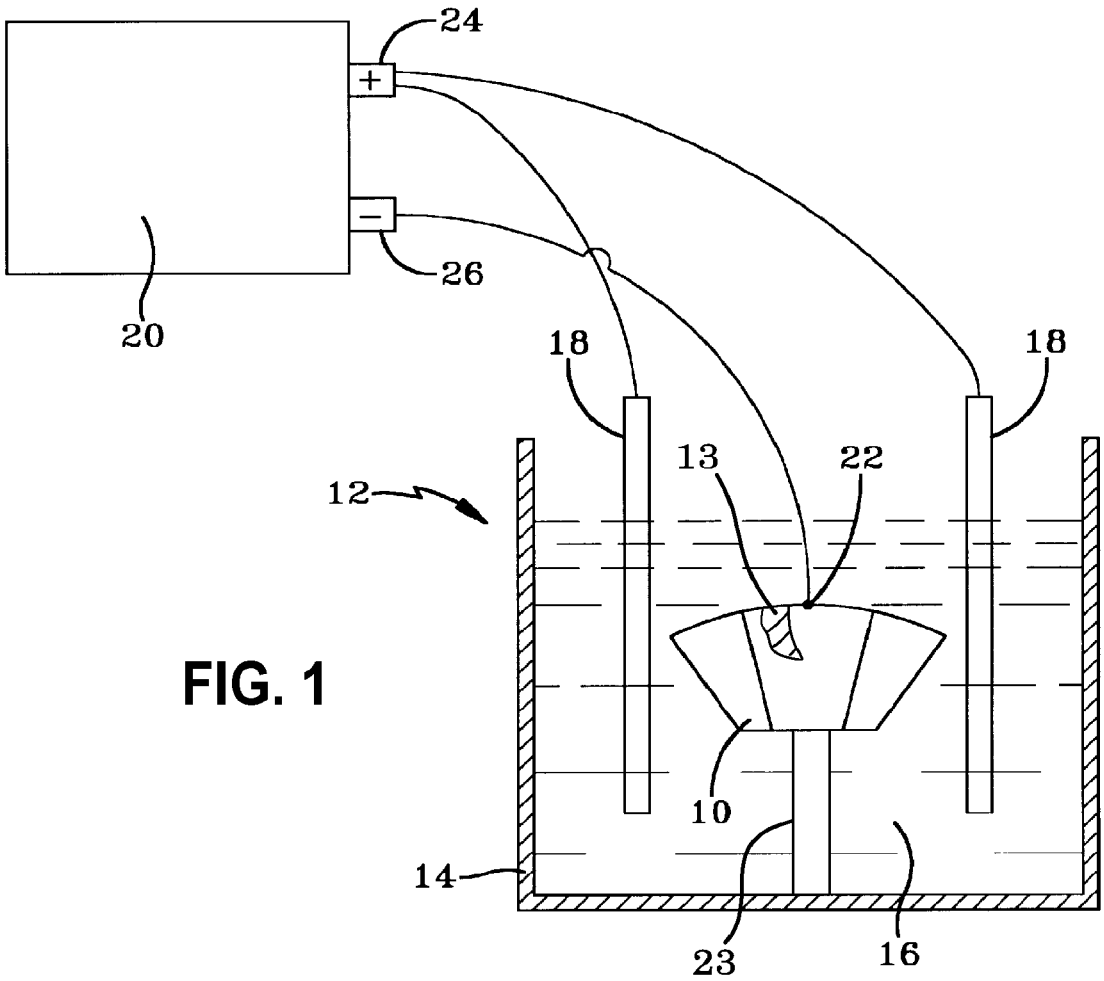
FIG. 1 illustrates schematically a first embodiment device useful in cleaning cast metal parts that are cast utilizing the disclosed foundry mixture.

Disclosed is a foundry mixture usable for forming a casting mold and/or a core for use with a casting mold for casting ferrous and non-ferrous metal parts, including metal parts made from aluminum, brass, bronze, iron, copper, gold, lead, magnesium, nickel, silver, steel, tungsten, zinc, and the like. The foundry mixture is cured to form a mold shell and/or mold core for foundry molding of the cast metal part.

The foundry mixture consists of a granular refractory material, a binder material, a cleaning agent, and may optionally include additives. The mixture may of course include impurities included with the addition of the materials forming the foundry mixture, but such impurities are not considered as forming a part of the foundry mixture.

The granular or particulate refractory material may be, in alternative embodiments, a sand formed from one or more of silica, olivine, chromite, zircon, and chamotte. Other sands conventionally used in foundry casting may also be used, including bank sands and synthetic sands. The sand may be coarse-grained sand, fine-grained sand, or be a mixture thereof.

The binder material may be a resin binder material, a non-resin binder material, a liquid cured binder material, a heat cured binder material.

The binder material may in embodiments be part of a resin binder that includes a resin as the binder material and may optionally include a suspension agent. Resins, in embodiments, may be (but are not limited to) urea formaldehyde (UF) resins, phenol formaldehyde (PF) resins, natural or synthetic gums, furan resins and furfuryl alcohols.

The resin binder material in embodiments may be a heat-curable resin in which heating the foundry mixture cures the resin to form a heat-cured resin binder. The resin binder in other embodiments may require a catalyst as a suspension agent. The catalyst when added to the foundry mixture reacts with the resin and cures the resin to form a cured resin binder.

The cleaning agent includes calcium oxide (CaO). The calcium oxide may, in embodiments, be obtained from limestone that is preferably 99% (ninety-nine percent) or more calcium oxide. The calcium oxide is preferably provided in powdered or finely ground form for use in preparing the disclosed foundry mixture. The cleaning agent in embodiments may consist only of calcium oxide.

The refractory material and the binder material (and the suspension agent if present) together form a first portion of the disclosed foundry mixture. The calcium oxide may in embodiments of the disclosed foundry mixture be present in the foundry mixture by weight or by volume between about ½% (one-half percent) and about 5% (five percent) of the first portion of the foundry mixture.

The following working example is given as an illustration only and is not intended to limit the scope of the disclosure. The results of tensile strength testing and loss on ignition testing for an embodiment of the disclosed foundry mixture are given below.

A sample of a foundry mixture that includes two-and-one-half percent (2½%) resin coated sand was mixed with one-half percent (½%) by weight finely ground calcium oxide. The foundry mixture was then formed into standard specimen "biscuits" used for the tensile testing of foundry mixtures. The biscuits were then cured and allowed to cool to room temperature. The average cold tensile strength of the biscuits was four hundred and forty-five (445) pounds per square inch. The average Loss on Ignition was two and sixty-nine hundredths percent (2.69%). Recommended values for a conventional 2½% resin mixture is a minimum cold tensile strength of 420 pounds per square inch and a Loss on Ignition of between two and sixty hundredths percent (2.60%) and two and ninety hundredths percent (2.90%).

In use for foundry casting, the foundry mixture is formed into at least a portion of a mold, and may also be used in forming one or more cores that are included as part of the mold for defining the shape of a cast part. The foundry mixture forming the mold and the one or more cores is cured to form a rigid matrix encapsulating the refractory material and capable of retaining the shape of the mold or core when the mold is being used to mold the molten metal. The molten metal flows into the mold and solidifies in the mold to form the cast metal part.

The type of ferrous or non-ferrous metal being cast, the alloys in the metal, the desired surface quality of the finished part, and other factors influence the selection of refractory material, binder, binder curing methods, and additives to be used in casting a specific metallic part as is known in the metal casting art and so will not be described in further detail herein.

The disclosed foundry mixture may be distributed in pre-mixed, pre-measured form in which the cleaning agent, refractory material, and binder are mixed together for convenience prior to use. If the binder material requires a suspension agent that is not compatible with a pre-mixed foundry mixture (that is, adding the suspension agent would start immediate curing of the binder material or would react or hydrate the calcium oxide cleaning agent), the pre-mixed mixture may be provided without a suspension agent (that is, with binder material only). The components may be mixed together using conventional high speed continuous mixers, low-speed augur-type continuous mixers, batch mixers. or other conventional mixing devices or mixing methods.

The shaping and curing of the disclosed foundry mixture to form a mold shell or core defining the desired shape of the casting produced by pouring melted metal into the mold, the formation of sprues, runners, and risers to flow molten material to and within the mold, including pattern making, lost wax casting, and other variations of shaping and curing a foundry mixture to achieve the desired shape of the casting are known in the foundry casting art and so will not be described in further detail herein.

After the molten metal cools and solidifies, the cast metal part is removed from the mold. Inner cores may remain in the removed part, and residual foundry mixture may adhere to casting surfaces.

FIG. 1 illustrates a cast metal part 10 formed by flowing molten (liquid) metal into a mold formed from the disclosed foundry mix. The illustrated foundry mixture includes a resin binder and calcium oxide as the sole cleaning agent. The part 10 is immersed in an electrolyzer 12 for removing cores or residual foundry mixture that includes the cleaning agent 13 from the cast metal part 10. The illustrated cast metal part 10 is a steel part. The electrolyzer 12 includes a nonmetallic container or vat 14 holding a liquid electrolyte 16, one or two electrodes 18, a power supply or current source 20, and a contact 22. The electrolyte 16 is a basic (alkaline) electrolyte. As shown in FIG. 1, the cast part 10 is immersed into the electrolyte 16 and is held in the electrolyte by a holder 23. The cast part 10 is connected to the contact 22. The electrodes 18 are connected to the positive output terminal 24 of the source 20. The contact 22 is connected to the negative output terminal 26 of the source 20.

Electrolyte 16 is an aqueous basic solution that, in the illustrated embodiment, is made of a mixture of water and potassium carbonate. The electrolyte 16 has a pH of 12, but in other embodiments the pH may have a basic pH different than 12.

An alternative illustrative and non-limiting embodiment of the electrolyte is an aqueous basic solution made of a mixture of water and sodium bicarbonate. The alternative embodiment electrolyte has a pH of between about 8.5 and about 9.0, that is, the pH of the alternative embodiment electrolyte has a pH closer to 8.5 than to 8, and closer to 9.0 than 9.5.

In the illustrated embodiment, the electrodes 18 are made of stainless steel rods. The power supply 20 produces a low voltage direct current output from 5 to 350 DC amps output from a 60 HZ, 230 V, 3 phase alternating current source. Power supply 20 can be an Invertec V300-Pro power source manufactured by The Lincoln Electric Company of Cleveland, Ohio. Other power supplies and electrodes may be used.

As shown in FIG. 1, the cast metal part 10 is totally immersed into electrolyte 16 and is connected to the source 20. The source 20 is energized to flow current across the electrolyzer 12 for cleaning the cast metal part 10. During normal cleaning, the source 20 is energized for from 2 to 3 minutes per cast metal part, depending on the binder, metal composition, size of the part, and so on.

While the source 20 is energized, some materials removed from the cast part 10 float on the top of the electrolyte 16. Used foundry sand sinks to the bottom of the vat 14 and is later removed from the vat 14 and may be resold as a concrete aggregate. The sand and floating material are physically removed from the vat 14 by occasionally collecting each into separate containers.

After cleaning, the power supply 20 is deactivated. The cast metal part 10 is removed from the electrolyte 16 and disconnected from contact 22. After removal, the part 10 may be lightly rinsed with water. After rinsing, the cast part 10 has been cleaned and is ready for any post-cleaning procedure. For example, the part 10 may be dried and subsequently painted.

FIG. 1 illustrates a single cast metal part 10 immersed in the vat 14 for cleaning. However, a number of cast metal parts 10 in contact with each other can be immersed in electrolyzer 12 for simultaneous cleaning of the parts. One of the parts 10 is connected to the contact 22. The other parts 10 touch the part 10 connected to contact 22 or form a series of parts that contact one another and include the part 10 connected to the contact 22.

In an alternative embodiment the vat 14 is a stainless steel tank connected to the negative terminal 26 of the source 20. The cast metal parts 10 would contact the vat 14 to be connected to the terminal 26.

In other possible embodiments of the electrolyzer 12, the cast metal part 10 is connected to a power source having terminals of opposite polarities. The cast metal part 10 immersed in the electrolyte 16 is electrically connected to one terminal, and the electrolyte 16 is electrically connected to the other terminal for flowing electric current from the power source 20 through the cast metal part 10 for cleaning.

Figure 2:
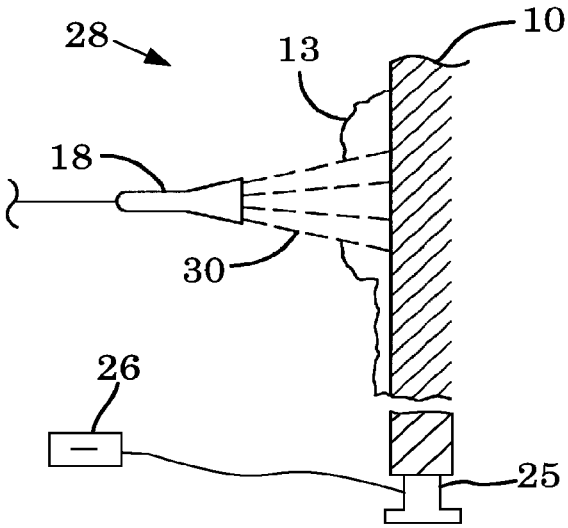
FIG. 2 illustrates schematically a second embodiment device useful in cleaning cast metal parts that are cast utilizing the disclosed foundry mixture.

FIG. 2 illustrates an alternative method of cleaning the cast metal part 10 utilizing an industrial parts washer 28. Industrial parts washers typically include one or more processing zones for cleaning, rinsing, drying and other steps for cleaning cast metal parts. A conveyor typically transports the parts through the processing zones from one end of the washer to the other. Industrial parts washers typically spray the parts with liquid, and so most washers include an enclosure to capture the spray and contaminants being washed. Some industrial parts washers include a holder to secure and support the part to be washed. The holder and the part to be cleaned are enclosed in a chamber that forms a sealed unit encapsulating the part. A cleaner dispersing system is operable to remove residual materials from the part.

A continuous stream or spray 30 of electrolyte 16 is sprayed on the cast metal part 10 from an electrode 18 formed as a spray device. The metal part 10 is connected to a positive lead 24 of the power source 20. The cast metal part 10 is secured by a holder 25 connected to the negative lead 26 of the power source 20. In alternative embodiments each spray electrode 18 is submerged in a reservoir of electrolyte 16. A drain basin (not shown) collects the sprayed electrolyte and filters out the used sand for collection. Use of an industrial parts washer enables continuous, "production line" cleaning of cast metal parts as part of an industrial process that manufactures and cleans cast metal parts that are then sent downstream for further processing.

Non-limiting examples of casting and cleaning molded metal parts using the disclosed foundry mixture are described below.

A foundry mixture that includes sand, a clay binder, and five percent finely ground calcium oxide was formed into a mold and molten metal was poured into the mold to form a cast metal part. The mixture was mixed in a first set of trials with water to have about 4 percent moisture content and mixed in a second set of trials with water to have about 2 percent moisture content. Different types of sand (silica, chromite, zircon olivine, staurolite, graphite) were used in each set. The water was used as a suspension agent but did not react with the calcium oxide—the calcium oxide was added as the last ingredient to the foundry mixture shortly before pouring the molten metal into the mold and so the calcium oxide did not hydrate.

The resulting mold was not electrically conductive. Electrolytic cleaning of the cast metal part as described above effectively removed adhering foundry mixture.

In yet another set of tests, a foundry mixture suitable for cold-box treatment included from one percent to five percent calcium oxide by weight as a cleaning agent. Molds formed by the cold-box treatment were not electrically conductive.

In yet another set of tests, foundry mixtures containing inorganic and organic binders included from between one percent and five percent calcium oxide as a cleaning agent. Molds formed from the foundry mixtures were not electrically conductive. Electrolytic cleaning of the cast metal parts as described above effectively removed adhering foundry mixture. It was found that the calcium oxide did not affect the strength of the molds formed by the foundry mixtures as compared to equivalent foundry mixtures but without the calcium oxide cleaning agent.

In an additional set of tests, foundry mixtures containing amine resin and furane resin binders (and no appreciable amount of water) that included calcium oxide as a cleaning agent. Molds formed from the foundry mixtures were not electrically conductive. Electrolytic cleaning of the cast metal parts as described above effectively removed adhering foundry mixture.

In a further set of tests with resin binders that included calcium oxide as a cleaning agent, it was found that removing the same amount of sand from the conventional foundry mixture as the amount of calcium oxide cleaning agent being added did not adversely impact the strength of the molds formed from the foundry mixture.

In embodiments, the disclosed foundry mixture includes a liquid cured binder material and calcium oxide as a cleaning agent. The liquid cured binder material may be an aqueous binder material. Where the liquid suspension agent used may chemically react with the calcium oxide, the amount of suspension agent should be such that sufficient calcium oxide not forming part of the binder material remains after curing to act as a cleaning agent, or the calcium oxide should be added to the foundry mixture in a way that effectively prevents chemical reaction with the calcium oxide. For example, the calcium oxide can be added as a final ingredient to a foundry mixture containing up to 7 percent water shortly before molten metal is poured into a mold formed from the foundry mixture. The heat of the molten metal poured into the mold is well above the boiling point of water. The water in the foundry mixture cannot react with the calcium oxide.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art and fall within the purview of the following claims.

What is claimed is:

1. A method for removing residual mold material from a cast metal part, the mold material having formed a rigid mold in which the metal part was cast, the method comprising the steps of:

wetting the outer surface of a body comprising the cast metal part and the residual mold material with an electrolyte; and flowing electric current through the electrolyte, wherein the mold material forming the rigid mold comprises particulate refractory material, a binder, and a cleaning agent, the cleaning agent comprising unhydrated calcium oxide, the binder binding the refractory material in a rigid binder matrix, the calcium oxide also being distributed throughout the rigid binder matrix and present in the residual mold material.

2. The method of claim 1 including the steps of:

mixing the binder with the refractory material to form a binder-refractory material mixture;

mixing water into the binder-refractory material mixture; and mixing calcium oxide in the binder-refractory material mixture after mixing the water into the binder-refractory material mixture.

3. The method of claim 1 wherein the electrolyte is a basic electrolyte.

4. The method of claim 1 wherein the electrolyte has a pH of 12 or greater.

5. The method of claim 1 wherein the step of wetting the outer surface comprises the step of immersing the entire metal part in the electrolyte.

6. The method of claim 5 wherein the step of wetting the outer surface comprises the step of spraying the metal part with the electrolyte.

7. The method of claim 6 wherein the step of flowing electric current comprises the steps of:

attaching the body to an electrical current source having a pair of electrodes of opposite polarities, one electrode attached to the metal part and the other electrode in contact with the electrolyte to define an electric circuit that includes the metal part and the electrolyte; and flowing electrical current through the electric circuit.

8. The method of claim 1 wherein the binder is a resin binder.

9. The method of claim 8 wherein the resin binder is a heat-treated resin binder or a catalyst-cured resin binder.

10. The method of claim 1 wherein the foundry mixture comprises an additive, the additive other than calcium oxide.

11. The method of claim 1 wherein the calcium oxide has a fineness of between about 100 mesh to about 500 mesh.

12. The method of claim 1 wherein the refractory material and the binder together comprise a first portion of the residual foundry mixture and the calcium oxide is between about ½% (one-half percent) and about 5% (five percent) by weight or by volume of the first portion of the residual foundry mixture.

13. The method of claim 1 wherein the mold material forming the mold in which the metal part was cast has a cold tensile strength not less than 420 pounds per square inch and/or has a Loss on Ignition not greater than two and ninety hundredths percent (2.90%).

14. The method of claim 1 wherein the refractory material is selected from the group of: synthetic sand, bank sand, silica, olivine, chromite, zircon, chamotte, staurolite, graphite, and mixtures thereof.

15. The method of claim 1 wherein the binder is selected from the group of: resin binder, non-resin binder, liquid cured binder, and heat cured binder.

16. The method of claim 1 wherein the binder is a hydrated binder.

17. The method of claim 16 wherein the hydrated binder comprises clay.

18. The method of claim 16 wherein the portion of the mold material that excludes the calcium oxide comprises no more than 7% (seven percent) water.

19. The method of claim 16 wherein the refractory material is selected from the group of: synthetic sand, bank sand, silica, olivine, chromite, zircon, chamotte, staurolite, graphite, and mixtures thereof.

20. The method of claim 19 wherein the portion of the mold material that excludes the calcium oxide has 7% (seven percent) or less of water.

* * * * *